US008383034B2

(12) United States Patent
Fukuda et al.

(10) Patent No.: US 8,383,034 B2
(45) Date of Patent: Feb. 26, 2013

(54) FERRITIC STAINLESS STEEL SHEET FOR WATER HEATER EXCELLENT IN CORROSION RESISTANCE AT WELDED PART AND STEEL SHEET TOUGHNESS

(75) Inventors: Kunio Fukuda, Tokyo (JP); Yoshimasa Funakawa, Tokyo (JP); Shuji Okada, Tokyo (JP); Toshihiro Kasamo, Tokyo (JP); Katsuhiro Kobori, Tokyo (JP); Takumi Ujiro, Tokyo (JP); Tomohiro Ishii, Tokyo (JP)

(73) Assignee: JFE Steel Corporation (JP)

( * ) Notice: Subject to any disclaimer, the term of this patent is extended or adjusted under 35 U.S.C. 154(b) by 361 days.

(21) Appl. No.: 12/516,212

(22) PCT Filed: Jan. 7, 2008

(86) PCT No.: PCT/JP2008/050224

§ 371 (c)(1),
(2), (4) Date: May 26, 2009

(87) PCT Pub. No.: WO2008/084838

PCT Pub. Date: Jul. 17, 2008

(65) Prior Publication Data

US 2010/0061878 A1 Mar. 11, 2010

(30) Foreign Application Priority Data

Jan. 12, 2007 (JP) ..... 2007-004021

(51) Int. Cl.
*C22C 38/44* (2006.01)
*C22C 38/48* (2006.01)
*C22C 38/46* (2006.01)

(52) U.S. Cl. ..... 420/68; 420/61; 420/63; 420/69; 148/325

(58) Field of Classification Search ..... 148/325; 420/61, 63, 68, 69
See application file for complete search history.

(56) References Cited

FOREIGN PATENT DOCUMENTS

| | | | |
|---|---|---|---|
| JP | 58-071356 A | | 4/1983 |
| JP | 359076857 | * | 5/1984 |
| JP | 402270942 | * | 11/1990 |
| JP | 5-271880 A | | 10/1993 |
| JP | 6-279951 A | | 10/1994 |
| JP | 7-286239 A | | 10/1995 |
| JP | 9-217151 A | | 8/1997 |
| JP | 10-081940 A | | 3/1998 |

(Continued)

OTHER PUBLICATIONS

Machine-English translation of Japanese patent 06-279951, Adachi Toshiro et al., Oct. 4, 1994.*

(Continued)

*Primary Examiner* — Deborah Yee
(74) *Attorney, Agent, or Firm* — DLA Piper LLP (US)

(57) ABSTRACT

A ferritic stainless steel sheet for a water heater with excellent corrosion resistance of welds and toughness includes, in terms of mass %, 0.020% or less of C, 0.30 to 1.00% of Si, 1.00% or less of Mn, 0.040% or less of P, 0.010% or less of S, 20.0 to 28.0% of Cr, 0.6% or less of Ni, 0.03 to 0.15% of Al, 0.020% or less of N, 0.0020 to 0.0150% of O, 0.3 to 1.5% of Mo, 0.25 to 0.60% of Nb, and 0.05% or less of Ti, the remainder being composed of Fe and unavoidable impurities, and the ferritic stainless steel sheet satisfying the following formulae (1) and (2):

$$25 \leqq Cr+3.3Mo \leqq 30 \quad (1)$$

$$0.35 \leqq Si+Al \leqq 0.85 \quad (2)$$

wherein Cr, Mo, Si, and Al represent the content (mass %) of Cr, Mo, Si, and Al, respectively.

3 Claims, 1 Drawing Sheet

FOREIGN PATENT DOCUMENTS

| | | | |
|---|---|---|---|
| JP | 2000-169943 | | 6/2000 |
| JP | 2001-020046 | A | 1/2001 |
| JP | 2001-288543 | | 10/2001 |
| JP | 2005-015816 | A | 1/2005 |
| JP | 2006-257544 | A | 9/2006 |
| JP | 2007-270290 | A | 10/2007 |
| WO | 2008/156195 | | 12/2008 |

OTHER PUBLICATIONS

Machine-English translation of Japanese patent 2000-169943, Abe Masayuki et al., Jun. 20, 2000.*

Machine-English transaltion of Japanese patent No. 11-323502, Tsuge Shinji et al., Nov. 26, 1999.*

Utsunomiya et al., "Development of Atmospheric Corrosion Resistant Ferritic Stainless Steel", 1994, vol. 70, pp. 45-58, *Nisshin Steel Technical Report*.

Adachi et al., "Ferritic Stainless Steel Developed for Household Hot-Water Tank Appliances" NSS445M2, 1992, No. 66, pp. 118-131, *Nisshin Steel Technical Report*, Nisshin Steel.

* cited by examiner

FERRITIC STAINLESS STEEL SHEET FOR WATER HEATER EXCELLENT IN CORROSION RESISTANCE AT WELDED PART AND STEEL SHEET TOUGHNESS

RELATED APPLICATIONS

This is a §371 of International Application No. PCT/JP2008/050224, with an international filing date of Jan. 7, 2008 (WO 2008/084838 A1, published Jul. 17, 2008), which is based on Japanese Patent Application No. 2007-004021, filed Jan. 12, 2007.

TECHNICAL FIELD

This disclosure relates to a ferritic stainless steel sheet for a water heater, the ferritic stainless steel sheet providing excellent corrosion resistance of welds and having excellent steel sheet toughness.

BACKGROUND

Ferritic stainless steel such as JIS (Japanese Industrial Standards)-SUS444 is less sensitive to stress corrosion cracking (SCC) than austenitic stainless steel, and thus has been used as a material of electric water heaters and the like.

However, running water contains residual chlorine which has been added for sanitary requirements, so that ferritic stainless steel used as a material of an electric water heater may be corroded by the oxygen behavior of the residual chlorine. In particular, welds (weld metals) and welded heat affected zones often have problems with corrosion resistance.

To improve corrosion resistance, for example, Japanese Unexamined Patent Application Publication No. 58-71356 discloses a method for improving corrosion resistance through the reduction of P and S, and C and N using a high purity refining technique.

Japanese Unexamined Patent Application Publication No. 10-81940 discloses a technique for improving the corrosion resistance of welds though limitation of Ti content, combined addition of Ti and Al, and addition of a proper amount of Cu.

Japanese Unexamined Patent Application Publication No. 7-286239 discloses ferritic stainless steel with excellent laser weldability, the ferritic stainless steel containing, in terms of % by mass, C≦0.03%, N≦0.025%, O≦0.02%, and 11%≦Cr≦35%, and the contents of C [% C], N [% N], O [% O], and Cr [% Cr] satisfying [% C]+3[% N]+[% O]< (124.4−[% Cr])/1750 such that the oxygen and nitrogen concentrations in the laser welding portions are 250 ppm or less and 350 ppm or less, respectively, the average particle diameter of the precipitated carbide and nitride is 3 μm or less, and the total precipitation density is $1\times10^5/mm^2$ or less.

Japanese Unexamined Patent Application Publication No. 9-217151 discloses ferritic stainless steel with excellent weldability, the ferritic stainless steel containing; in terms of % by mass, 0.001%≦c≦0.08%, 0.01%≦Si≦1.0%, 0.01%≦Mn≦2.0%, 10.5%≦Cr≦32.0%, 0.001%≦N≦0.04%, 0.005%≦Al≦0.2%, 0.001%≦Mg≦0.02%, and 0.001%≦O≦0.02%, the remainder being composed of Fe and unavoidable impurities.

Japanese Unexamined Patent Application. Publication No. 2005-15816 discloses a can body for a water heater with excellent corrosion resistance, the can body being joined to the upper and lower barreiheads by caulking, the can body being composed of ferritic stainless steel sheet containing, in terms of % by mass, C≦0.003%, 0.1%≦Si≦0.4%, Mn≦0.4%, P≦0.04%, S≦0.01%, 16.0%≦Cr≦25.0%, 0.8%≦Mo≦2.5%, N≦0.03%, 0.1%≦Nb≦0.6%, 0.05%≦Ti≦0.3%, and 0.01%≦Al≦0.5%, the Nb, Ti, C, and N satisfying Nb+Ti≧7(C+N)+0.15, and the remainder substantially being Fe.

Japanese Unexamined Patent Application Publication No. 2006-257544 discloses ferritic stainless steel with excellent crevice corrosion resistance, the ferritic stainless steel containing, in terms of % by mass, 0.001%≦C≦0.02%, 0.001%≦N≦0.02%, 0.01%≦Si≦0.3%, 0.05%≦Mn≦1%, P≦0.04%, 0.15%≦Ni≦3%, 11%≦Cr≦22%, 0.01%≦Ti≦0.5%, and 0.0002%≦Mg≦0.002%, in addition, one or more selected from Mo, Nb, and Cu with percentages of 0.5≦Mo≦3.0%, 0.02%≦Nb≦0.6%, and 0.1%≦Cu≦1.5% within a range satisfying Cr+3Mo+6(Ni+Nb+Cu)≧23, the remainder being Fe and unavoidable impurities.

In recent years, along with tightening of sanitary requirements, Building Health Laws or Building Management Laws were revised in Japan in 2003 to require hot water fed in specific buildings to contain 0.1 mg/L or more of chlorine. As a result of this, in consideration of consumption of the residual chlorine, the chlorine concentration in hot water fed by a hot-water supply system must be increased. Therefore, sufficient corrosive resistance of welds may not be achieved with the known techniques disclosed in Japanese Unexamined Patent Application Publication Nos. 58-71356, 10-81940, 7-286239, 9-217151, 2005-15816, and 2006-257544.

It could therefore be helpful to provide a ferritic stainless steel sheet for a water heater, the steel sheet having sufficient toughness, and providing sufficient corrosion resistance of welds in spite of an increase of chlorine concentration.

SUMMARY

We provide:

[1] A ferritic stainless steel sheet for a water heater with excellent corrosion resistance of welds and toughness, including, in terms of mass %, 0.020% or less of C, 0.30 to 1.00% of Si, 1.00% or less of Mn, 0.040% or less of P, 0.010% or less of S, 20.0 to 28.0% of Cr, 0.6% or less of Ni, 0.03 to 0.15% of Al, 0.020% or less of N, 0.0020 to 0.0150% of O, 0.3 to 1.5% of Mo, 0.25 to 0.60% of Nb, and 0.05% or less of Ti, the remainder being composed of Fe and unavoidableimpurities, and the ferritic stainless steel sheet satisfying the following formulae (1) and (2):

$$25 \leqq Cr+3.3Mo \leqq 30 \quad (1)$$

$$0.35 \leqq Si+Al \leqq 0.85 \quad (2)$$

wherein Cr, Mo, Si, and Al represent the contents (mass %) of Cr, Mo, Si, and Al, respectively.

[2] The ferritic stainless steel sheet for a water heater of [1], which further includes, in terms of mass %, 0.005 to 0.50% of V, more than 22% to 28.0% of Cr, and satisfies the following formula (3):

$$0.1 \leqq 4V/(Nb-8(C+N)) \leqq 5.0 \quad (3)$$

wherein V, Nb, C, N represent the contents (mass %) of V, Nb, C, and N, respectively.

[3] The ferritic stainless steel sheet for a water heater of [1] or [2] with excellent corrosion resistance of welds and toughness, which further includes, in terms of mass %, 0.2 to 1.0% of Cu and/or 0.10 to 0.60% of Zr.

In the present description, all the percentage figures given for components of the steel refer to mass %.

Ferritic stainless steel for a water heater exhibiting excellent corrosion resistance of welds and toughness is obtained. Further, we solve the above-described problems through the optimization of the component system, so that the corrosion resistance of welds is improved without deteriorating the productivity of the steel sheet.

The ferritic stainless steel exhibits excellent toughness of the hot-rolled steel sheet, and improved corrosion resistance of welds. Therefore, when the steel is used as a can body material of a water heater, damages caused by corrosion of welds are markedly reduced regardless of an increase in residual chlorine content in running water, which results in the achievement of remarkable industrial effects.

DETAILED DESCRIPTION

We studied the influence of chemical components of the steel on the corrosion resistance of the base material and welds, and the influence of chemical components of the steel on the manufacturability of the steel sheet.

In the production of a can body for a water heater, TIG (tungsten inert gas) welding is commonly used. In TIG welding, the front and back sides of welds are shielded with inert gas to minimize the formation of temper color (oxide layer) on the welds. However, the gas shield is not perfect in a practical process, so that oxygen in the air slightly intrudes to form an oxide layer called as temper color on the weld beads on the top and back sides of the welds.

As a result, we found that the oxide layer consumes Cr contained in the base material to decrease the Cr concentration in the base material immediately below the oxide layer, which is a leading cause of the deterioration of corrosion resistance. Then, the relationship between the properties of oxide layers formed at different temperatures, the Cr concentration in the underlayer, and the corrosion resistance were studied. The results indicate that, when the maximum heating temperature is 1000° C. or higher, an oxide layer formed at a temperature of 1000° C. or higher selectively contains a large amount of Cr, and that the corrosion resistance of the base material with a low Cr content markedly deteriorates even if the Mo content in the steel is high. On the other hand, when the maximum heating temperature is from 800 to below 1000° C., an oxide layer formed at a temperature from 800 to below 1000° C. generates Cr oxides at low speeds, and Cr rapidly diffuses from the base material to the surface of the steel sheet, so that the corrosion resistance is relatively less affected. When the maximum heating temperature is below 800° C., an oxide layer formed at a temperature below 800° C. generates Cr oxides at low speeds, but Cr slowly diffuses from the base material to the surface of the steel sheet, which results in the deterioration of the corrosion resistance. However, we found that, in the temperature range, a high-density protective coating is formed through selective formation of Si and Al oxides, which reduces the deterioration of the corrosion resistance.

Figure 1:
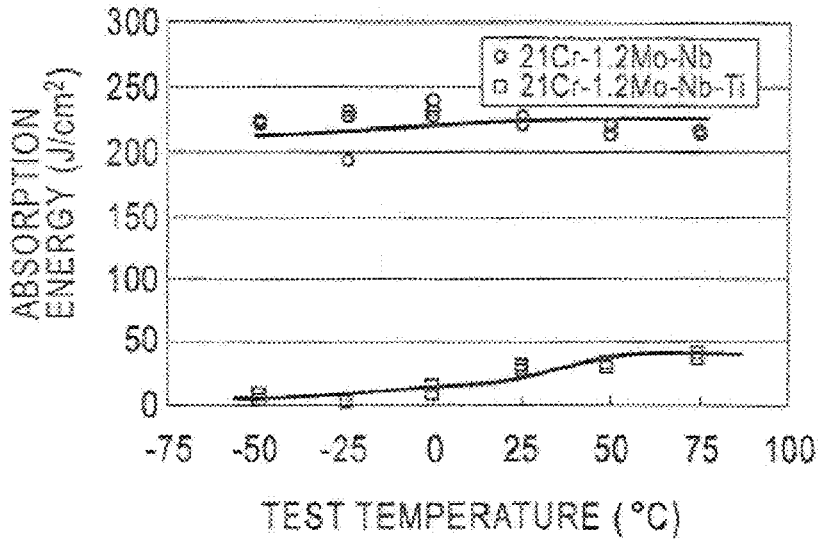
FIG. 1 is a graph showing the result of Charpy impact test on two 4 mm-thick hot-rolled steel sheets with different compositions (relationship between the test temperature and absorption energy).
Figure 2:
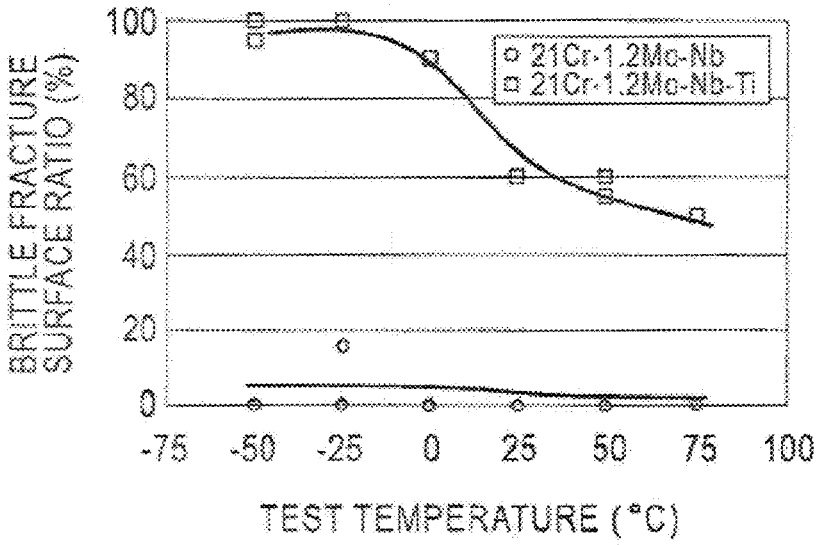
FIG. 2 is a graph showing the result of Charpy impact test on two 4 mm-thick hot-rolled steel sheets with different compositions (relationship between the test temperature and brittle fracture surface ratio).

We also found that an increase in Cr concentration in the base material results in deterioration of toughness, specifically the toughness of the hot-rolled steel sheet, which results in the rupture of the steel strip during annealing of the hot-rolled steel sheet or cold rolling to markedly deteriorate the productivity. On the other hand, we found that the deterioration of the toughness of a hot-rolled steel sheet can be prevented by adding Nb as an element for fixing C and N thereby reducing Ti. FIGS. 1 and 2 show the results of a Charpy impact test on 4 mm-thick hot-rolled steel sheets, one of which is made of 21% Cr-1.2% Mo steel with low C and N contents added with 0.3% of Nb alone, and the other is made of the same 21% Cr-1.2% Mo steel with low C and N contents added with a combination of 0.2% of Nb and 0.1% of Ti. According to the results shown in FIGS. 1 and 2, the addition of a small amount of Ti caused a marked deterioration of the toughness of the hot-rolled steel sheet, and that, regardless of the increase in Cr concentration, the addition of Nb alone as an element for fixing C and N allows the production of a steel sheet with no deterioration of the productivity of the steel sheet (steel strip).

We thus found that the corrosion resistance of welds is markedly influenced by the oxide layer formed during welding and the base material immediately below the oxide layer.

The deterioration of the corrosion resistance of welds can be prevented by the selective formation of Al and Si oxides.

The addition of Ti and Nb improves the corrosion resistance of the base material. However, the addition of an excessive amount of Ti deteriorates the toughness of the steel sheet, specifically the toughness of the hot-rolled steel sheet to markedly deteriorate the productivity of the steel sheet.

First, the chemical composition is described.

C: 0.020% or less

C tends to combine with Cr to form a Cr carbide. Since formation of a Cr carbide in a heat affected zone during welding results in intergranular attack, the content of C is preferably as low as possible. Accordingly, the C content is defined as being 0.020% or less, and more preferably 0.014% or less.

Si: 0.30 to 1.00%

Si is an element effective for the corrosion resistance of welds, and is an important element. In particular, when a high-density Si oxide layer is formed on the heat affected zone by oxidation during welding, whereby the deterioration of the corrosion resistance of the base material is prevented. For example, when the ferritic stainless steel sheet is used as a can body material of a water heater, in a solution containing residual chlorine, the addition of 0.30% or more of Si forms a high-density layer, minimizes the oxidation of Cr, prevents the deterioration of the Cr concentration in the oxide layer and iron base immediately below the oxide layer, prevents deterioration of the corrosion resistance of the base material, thus achieving the effect of the oxide layer at welds. Accordingly, the Si content is defined as being 0.30% or more, and is preferably 0.40% or more. On the other hand, Si deteriorates the pickling properties of hot-rolled and cold-rolled steel sheets thus deteriorating the productivity. Further, the addition of an excessive amount of Si causes stiffening of the material, which results in the deterioration of the processability. Accordingly, the upper limit of the Si content is defined as being 1.00%, and is more preferably 0.80%.

Mn: 1.00% or less

Mn combines with S contained in the steel to form MnS, which is a soluble sulfide, thereby deteriorating the corrosion resistance. Accordingly, the Mn content is defined as being 1.00% or less, and is more preferably 0.60% or less.

P: 0.040% or less

P is an element adversely affecting the corrosion resistance. The influence is significant when the P content is more than 0.040%. Accordingly, the P content is defined as being 0.040% or less, and is more preferably 0.030% or less.

S: 0.010% or less

S is an element adversely affecting the corrosion resistance. In particular, when S and Mn are present together, they form MnS, which markedly influences the corrosion resistance when its content is more than 0.010%. Accordingly, the S content is limited to 0.010% or less, and is more preferably 0.006% or less.

Cr: 20.0 to 28.0%

As described above, when a can body of a water heater is made, it is preferred that welding be conducted under such conditions that the formation of an oxide layer on the surface of welds is minimized. However, as described above, in a practical process, the gas shield for the top and back sides of the welds is not perfect, so that oxygen in the air slightly intrudes to form an oxide layer called as temper color on the weld beads on the top and back sides of the welds. The oxide layer consumes Cr in the base material to decrease the Cr concentration in the oxide layer and the base material immediately below the oxide layer, which is a leading cause of the deterioration of the corrosion resistance. In particular, an oxide layer formed at a temperature of 1000° C. or higher selectively contains a large amount of Cr. When the Cr concentration in the base material is low, the corrosion resistance in the temperature range markedly deteriorates in spite of an increase in Mo content. In particular, when the Cr content is 20.0% or less in a temperature range higher than 1000° C., the corrosion resistance of welds is unstable regardless of the contents of Mo and other elements, which results in pitting corrosion particularly in crevice portions. Accordingly, the lower limit of the Cr content is defined as being 20.0% or more. If the Cr content is more than 28.0%, the processability markedly deteriorates. Accordingly, the Cr content is defined as being 20.0% or more and 28.0% or less, and is preferably more than 22.0% and 25.5% or less.

Ni: 0.6% or less

Ni is an element favorably contributing to the improvement of toughness. To achieve this, the Ni content is preferably 0.1% or more. However, if the Ni content is more than 0.6%, sensitivity to stress corrosion cracking (SCC) increases. Accordingly, the Ni content is defined as being 0.6% or less, and is more preferably 0.4% or less.

Al: 0.03 to 0.15%

Same as Si, Al is also an important element regarding the oxide layer formed at a temperature lower than 800° C. Inclusion of Al at a ratio of 0.03% or more improves the corrosion resistance. On the other hand, Al forms oxides immediately below the oxide layers on the hot-rolled and cold-rolled steel sheets to consolidate the oxide layers thereby hindering pickling to deteriorate the productivity. Accordingly, the Al content is defined as being 0.03% or more and 0.15% or less, and is more preferably from 0.06 to 0.12%.

N: 0.020% or less

N tends to combine with Cr to form a Cr nitride. Since the formation of a Cr nitride in a heat affected zone during welding results in intergranular attack, the N content is preferably as low as possible. Accordingly, the N content is defined as being 0.020% or less, and more preferably 0.014% or less.

O: 0.0020 to 0.0150%

O (oxygen) is an element increasing the depth of penetration at welds. To achieve this, the O content is preferably 0.0020% or more. If the O content is more than 0.0150%, the amount of inclusions increases, and the presence of the inclusions results in a marked deterioration of the corrosion resistance. Accordingly, the O content is defined as being 0.0020% or more and 0.0150% or less, and is more preferably from 0.0030 to 0.0100%.

Mo: 0.3 to 1.5%

Mo is an element that markedly improves the corrosion resistance. The effect of improvement is marked when the Mo content is 0.3% or more. If the Mo content is more than 1.5%, the toughness markedly deteriorates, and the processability of the cold-rolled steel sheets also deteriorates within the Cr concentration range. Accordingly, the Mo content is defined as being 0.3% or more and 1.5% or less, and is preferably 0.7% or more and 1.2% or less.

Nb: 0.25 to 0.60%

Nb forms a carbonitride prior to Cr. Therefore, Nb prevents the formation of Cr carbonitrides after hot rolling thereby suppressing the deterioration of the toughness. Accordingly, the Nb content is defined as being 0.25% or more. If the Nb content is more than 0.60%, the toughness of the hot-rolled steel sheet deteriorates, and the corrosion resistance of welds also deteriorates. Accordingly, the Nb content is defined as being 0.25 to 0.60%, and is preferably from 0.30 to 0.50%.

V: 0.005 to 0.50%

V is an element that improves the corrosion resistance. The improvement of the corrosion resistance of the base material indirectly results in the improvement of the corrosion resistance of welds. In addition, it has been found that the coexistence of V with Nb improves oxidation resistance. The mechanism has not been fully elucidated, but it was confirmed by an oxidation test at a temperature of 1100° C. or higher that an oxide is formed by the coexistence of Nb and V on the surface of a steel sheet immediately below an oxide layer. This is likely due to the fact that the formation of the oxide by the coexistence of Nb and V on the steel sheet surface further suppresses the diffusion of Fe and Cr from the steel sheet toward the outside, which results in the reduction of the amount of oxidation of the steel sheet. The effect likely suppresses the oxidation of Fe and Cr in the steel sheet during formation of the oxide layer immediately after welding even at high temperatures of 1100° C. or higher thereby preventing the formation of a layer devoid of Cr, and accelerating the formation of a high-density oxide layer composed of Al and Si, which are elements consolidating the oxide layer, immediately below the oxide layer to improve the corrosion resistance of welds. To improve the corrosion resistance of the base material and reinforce the oxide layer, the V content must be 0.005% or more. However, the addition of an excessive amount of V inhibits the formation of an oxide layer which serves as a lubricant during hot rolling, which results in the formation of surface defects made up of many asperities of several millimeters caused by metallic contact between the steel strip and rolling mill rolls. The surface defects deteriorate the corrosion resistance of the welds and base material. To achieve good surface quality, the V content must be 0.50% or less. Accordingly, the V content is defined as being from 0.005 to 0.50%, and is more preferably from 0.01 to 0.20%.

Ti: 0.05% or less

Ti is an important element. In the same manner as Nb, Ti forms a carbonitride prior to Cr, and improves the corrosion resistance of welds and other portions. Therefore, Ti is a desirable element for achieving good corrosion resistance of welds. However, as described above, the addition of Ti together with Cr and Mo at a ratio markedly deteriorates the toughness of the hot-rolled steel sheet, even though its amount is small. In addition, Ti may generate TiN or the like in a steel slab to cause surface defects (tearing flaws) on a cold-rolled steel sheet. Accordingly, the Ti content is defined as being 0.05% or less, and is preferably 0.03% or less.

Further, to improve the corrosion resistance of welds, the following formulae (1) and (2) must be satisfied:

$$25 \leqq Cr+3.3Mo \leqq 30 \quad (1)$$

$$0.35 \leqq Si+Al \leqq 0.85 \quad (2).$$

The lower limit of the formula (1) is a requirement to achieve the corrosion resistance of the base material and welds even in hot water with a high concentration of residual chlorine. On the other hand, if the corrosion resistance of the base material is markedly different from that of the welds deteriorated by the formation of an oxide layer after welding, dissolution occurs preferentially in the areas having an oxide layer, which results in the acceleration of crevice corrosion. Accordingly, in the formula (1), the upper limit is defined as being 30, and is more preferably from 26 to 29.

The formula (2) represents the requirement to achieve the corrosion resistance of welds. When Si and Al are present together, the Si and Al oxides form a sufficient protective layer to suppress the deterioration of corrosion resistance. To achieve this sufficiently, in the formula (2), Si+Al must be 0.35 or more. As a result of detailed study, we found that the Si and Al elements concentrate during the formation of an oxide layer immediately below the oxide layer to hinder the deterioration of the corrosion resistance. When the upper limit defined by the formula (2) is exceeded, Si and/or Al excessively grow, which results in a failure to form a high-density protective layer without pinholes. Accordingly, in the formula (2), the upper limit is defined as being 0.85, and is more preferably from 0.40 to 0.75.

Further, when V is added as a preferred element to further improve the corrosion resistance of welds and the surface quality, the following formula (3) must be satisfied:

$$0.1 \leqq 4V/(Nb-8(C+N)) \leqq 5.0 \quad (3).$$

The lower limit defined in the formula (3) is a requirement to further improve the corrosion resistance of welds. If the volume ratio of V to the Nb solid solution is below a specific value, sufficient oxidation resistance cannot be achieved, so that the corrosion resistance will not be improved. The upper limit defined by the formula (3) is a requirement to further improve the corrosion resistance of welds and the surface quality. If the proportion of V is too high, oxidation resistance is too strong, which inhibits the formation of a high-density protective layer composed of Al and Si, and hinders the formation of an oxide layer during hot rolling to cause surface defects due to metallic contact. Accordingly, in the formula (3), the lower and upper limits are defined as 0.1 and 5.0, respectively, and are more preferably 0.5 and 4.0, respectively.

The remainder other than the above-described components is composed of Fe and unavoidable impurities. The unavoidable impurities may be 0.0020% or less of Mg and 0.0020% or less of Ca.

The steel sheet provides intended properties when it contains the above-described essential elements. According to desired properties, the steel sheet may further contain the following elements.

Cu: 0.2 to 1.0%

When Cu is added to steel containing 20.0% or more of Cr, it improves the corrosion resistance of the base material. The effect of Cu is enhanced in a halogen-containing low pH acid solution, and the addition of 0.2% or more of Cu reduces the dissolution of the iron base. The mechanism has not been fully elucidated, but is likely due to the fact that Cu dissolved in the low pH solution reattaches to the iron base to enhance the dissolution resistance. If the Cu content is more than 1.0%, dissolution of Cu is accelerated, which may result in the deterioration of crevice corrosion resistance. Accordingly, the Cu content is defined as being 0.2% or more and 1.0% or less, and is preferably 0.3% or more and 0.7% or less.

Zr: 0.10 to 0.60%

In the same manner as Nb, Zr forms a carbonitride prior to Cr, and improves the corrosion resistance of welds and other portions. Therefore, Zr is a desirable element for achieving good corrosion resistance of welds. The effect is achieved when Zr is added in a proportion of 0.10%. On the other hand, if Zr is added in an excessive amount, it may form an intermetallic compound that deteriorates the toughness of the hot-rolled steel sheet. Accordingly, the Zr content is defined as being 0.10% or more and 0.60 or less, and is preferably 0.15% or more and 0.35% or less.

The following section describes the method for making the ferritic stainless steel sheet for a water heater with excellent corrosion resistance of welds and toughness.

There is no specific limitation on the method for making the ferritic stainless steel sheet for a water heater with excellent corrosion resistance of welds and toughness.

Molten steel having the above-described composition is ingoted by a known device such as a steel converter, an electric furnace, or a vacuum fusion furnace to make a steel material (slab) by a continuous casting method or an ingot casting-blooming method. The steel material is then heated, or directly hot-rolled without heating to make a hot-rolled steel sheet. The hot-rolled steel sheet is usually subjected to annealing, but the annealing treatment may be omitted according to the intended use. Subsequently, the steel sheet is subjected to pickling, and then cold-rolled to make a cold-rolled steel sheet. The cold-rolled steel sheet is subjected to annealing and pickling to make a product. In usual cases, for water heater uses, the steel sheet is used as JIS G4305 2B (skin pass rolled steel sheet) product. The processed steel sheet may be subjected to polishing or other treatment.

In a more preferred production method, some conditions of the hot rolling and cold rolling processes meet specific conditions. In steel making, it is preferred that the molten steel containing the above-described essential components and other components, which are added as necessary, be ingoted in, for example, a steel converter or an electric furnace, followed by secondary smelting by a VOD process. The ingot of the molten steel may be made into a steel material by a known production method, preferably continuous casting from the viewpoint of productivity and quality. The steel material obtained by continuous casting is heated to, for example, 1000 to 1250° C., and subjected to hot rolling at a finishing temperature of 700 to 950° C. to make a hot-rolled steel sheet having an intended thickness. The material may be in a form other than that of a sheet. The hot-rolled steel sheet is, as necessary, subjected to batch annealing at 600 to 800° C. or continuous annealing at 900° C. to 1100° C., and then descaled by pickling or the like to make a hot-rolled steel sheet product. As necessary, shot blasting may be conducted before the pickling thereby removing the oxide layer.

Further, to obtain a cold-rolled annealed sheet (recrystallized annealed sheet), the hot-rolled annealed sheet obtained as described above is subjected to cold rolling to make a cold-rolled steel sheet. In the cold rolling process, according to the circumstances of production, cold rolling including process annealing may be conducted twice or more as necessary. The total rolling reduction by the cold-rolled process including one or more times of cold rolling is defined as being 60% or more, preferably 70% or more. The cold-rolled steel sheet is subjected to continuous annealing (cold-rolled steel sheet annealing) at 950 to 1150° C., more preferably 980 to 1120° C., and then to pickling to make a cold-rolled annealed sheet. According to the intended use, the cold-rolled annealing may be followed by mild rolling such as skin pass rolling thereby adjusting the form and quality of the steel sheet.

The cold-rolled annealed sheet produced as described above is subjected to bending or other processing according to the intended use thereby forming, for example, a can body of water heater. The method for welding these members is not particularly limited, and examples of the method include common arc welding methods such as MIG (metal inert gas) welding, MAG (metal active gas) welding, and TIG (tungsten inert gas) welding, resistance welding methods such as spot welding and seam welding, and high-frequency resistance welding and high-frequency induction welding such as electric resistance welding.

Example 1

Steels having the compositions listed in Table 1 (steel No. 1 to 17 are examples, No. 18 to 22, A, B are comparative examples, and No. 23 and 24 are examples of prior art) were ingoted in a small scale vacuum melting furnace with a capacity of 50 kg. These steel ingots were heated to 1050 to 1250° C., and subjected to hot rolling at a finishing temperature of 750 to 950° C. and a coiling temperature of 650 to 850° C. thereby making hot-rolled steel sheets having a thickness of 4.0 mm.

First, the toughness of the hot-rolled steel sheets thus obtained was examined. The specimens used for the examination, which had a form of JIS Z2202 No. 4, were subjected to Vnotch processing so as to have a V notch in the C direction perpendicular to the rolling direction, and then to Charpy impact test. The toughness was evaluated on the basis of the brittle fracture surface ratio determined by the observation of the fracture cross section at 0° C. with a microscope and a SEM (scanning electron microscope). Subsequently, the hot-rolled steel sheets obtained as described above were subjected to annealing at 900 to 1100° C. Thereafter, the sheets were subjected to pickling, and then to cold rolling to make cold-rolled steel sheets having a thickness of 1.0 mm, and the sheets were subjected to annealing at 950 to 1100° C. At that time, the presence or absence of surface defects due to metallic contact with the rolling mill roll was visually observed. The specimens thus obtained were subjected to the measurement of the pitting corrosion potential ($V'_{c10}$) at 30° C. in a 3.5% NaCl solution, according to JIS G 0577 "pitting potential measuring method for stainless steels." Further, specimens taken from the respective steel sheets were subjected to bead on plate TIG welding under the following conditions. The welding current was controlled such that the width of the weld bead on the back side was 3 mm or more. The evaluation was made on the backside weld bead.

Welding voltage: 10 V

Welding current: 90 to 110A

Welding speed: 600 mm/min

Electrodes: tungsten electrodes having a diameter of 1.6 mm

Shielding gas: topside weld bead: 100 vol % Ar 20 L/min, backside weld bead: 98 vol % Ar+2 vol % $O_2$ 20 L/min The specimens obtained as described above were subjected to the measurement of the pitting corrosion potential ($V'_{c10}$) of welds at 30° C. in a 3.5% NaCl solution, according to JIS G 0577 "pitting potential measuring method for stainless steels," except that grinding before the test and standing for 10 minutes after immersion in the test solution were not carried out, and the scan of potential was immediately started.

Further, to examine the corrosion resistance in an environment in which the water heater to be used, the pitting corrosion potential of welds was measured at 80° C. in a solution containing 200 mass ppm of chlorine ions (200 ppm$Cl^-$). The method followed the above-described JIS G 0577 "pitting potential measuring method for stainless steels," except for the temperature and solution concentration, and that grinding before the test and standing for 10 minutes after immersion in the test solution were not carried out, and the scan of potential was immediately started.

Further, to examine the corrosion resistance in an environment in which the water heater is used, welded specimens were subjected to an immersion test. The test solution was a 0.1% NaCl+0.1% $CuCl_2$ aqueous solution maintained at 80° C. The welded specimens were immersed in the test solution for 15 days including three cycles, wherein the test solution was replaced every five days, and the maximum depth of the pitting corrosion developed at welds was measured.

The corrosion resistance of welds were rated based on the maximum depth of pitting corrosion:

A: less than 10 μm

B: 10 μm or more and less than 20 μm

C: 20 μm or more and less than 50 μm

D: 50 μm or more.

The results of the above tests are shown in Table 2.

The comprehensive evaluation was made by giving scores 5-0 to the results of the brittle fracture surface ratio at 0° C. in the Charpy test, presence or absence of surface defects, pitting corrosion potential of the base material, pitting corrosion potential of welds (3.5% NaCl), pitting corrosion potential of welds (200 ppm$Cl^-$), and 0.1% NaCl+0.1% $CuCl_2$ aqueous solution test, and rating the total score 25 to 30 as ⊙ (A), 20 to 24 as ○ (B), 15 to 19 as Δ (C), and 14 or less as x (D).

The respective items were scored on the following criteria.

Regarding the brittle fracture surface ratio at 0° C. in the Charpy test, 20% or less received a score of 5, 20 to 80% received 2, and 80% or more received 0.

Regarding the presence or absence of surface defects, those having no surface defect received a score of 5, and those having a surface defect received 0.

Regarding the pitting corrosion potential of the base material, a potential of 500 mV or more received a score of 5, 450 to 500 mV received 2, and 450 mV or less received 0.

Regarding the pitting corrosion potential of welds (3.5% NaCl), a potential of 100 mV or more received a score of 5, 0 to 100 mV received 2, and 0 mV or less received 0.

Regarding the 0.1% NaCl+0.1% $CuCl_2$ aqueous solution test, those rated as A received a score of 5, B received 2, and C and D received 0.

The results shown in Table 2 indicate that the examples have excellent toughness and corrosion resistance. On the other hand, the comparative examples and examples of prior art outside the scope of this disclosure are inferior in the toughness and/or corrosion resistance.

Industrial Applicability

Our steel sheets are suitable as members required to have excellent toughness and corrosion resistance, specifically the corrosion resistance of welds, used to make, for example, an electric water heater.

TABLE 1

| Steel No. | Composition (mass %) C | Si | Mn | P | S | Cr | Ni | Al | N | O | Mo | Nb |
|---|---|---|---|---|---|---|---|---|---|---|---|---|
| 1 | 0.007 | 0.42 | 0.15 | 0.025 | 0.001 | 22.5 | 0.11 | 0.095 | 0.008 | 0.0050 | 1.10 | 0.31 |
| 2 | 0.006 | 0.35 | 0.15 | 0.020 | 0.001 | 23.5 | 0.13 | 0.050 | 0.012 | 0.0085 | 0.95 | 0.44 |
| 3 | 0.004 | 0.55 | 0.25 | 0.030 | 0.002 | 20.5 | 0.08 | 0.038 | 0.015 | 0.0145 | 1.40 | 0.25 |
| 4 | 0.011 | 0.38 | 0.25 | 0.030 | 0.002 | 26.1 | 0.09 | 0.056 | 0.009 | 0.0025 | 0.80 | 0.32 |
| 5 | 0.008 | 0.45 | 0.15 | 0.025 | 0.002 | 24.8 | 0.23 | 0.090 | 0.005 | 0.0065 | 1.10 | 0.45 |
| 6 | 0.006 | 0.60 | 0.17 | 0.035 | 0.001 | 21.5 | 0.15 | 0.045 | 0.008 | 0.0035 | 1.20 | 0.25 |
| 7 | 0.015 | 0.39 | 0.16 | 0.025 | 0.001 | 23.1 | 0.16 | 0.052 | 0.009 | 0.0035 | 1.42 | 0.33 |
| 8 | 0.007 | 0.70 | 0.18 | 0.035 | 0.001 | 24.5 | 0.18 | 0.036 | 0.013 | 0.0030 | 0.93 | 0.25 |
| 9 | 0.008 | 0.55 | 0.15 | 0.020 | 0.002 | 21.3 | 0.22 | 0.045 | 0.006 | 0.0025 | 1.25 | 0.38 |
| 10 | 0.002 | 0.45 | 0.25 | 0.025 | 0.003 | 22.8 | 0.15 | 0.087 | 0.007 | 0.0020 | 1.08 | 0.41 |
| 11 | 0.003 | 0.44 | 0.15 | 0.035 | 0.002 | 21.7 | 0.16 | 0.092 | 0.005 | 0.0080 | 1.33 | 0.33 |
| 12 | 0.006 | 0.39 | 0.17 | 0.040 | 0.001 | 20.9 | 0.09 | 0.090 | 0.004 | 0.0030 | 1.45 | 0.31 |
| 13 | 0.008 | 0.35 | 0.18 | 0.035 | 0.001 | 21.5 | 0.18 | 0.123 | 0.006 | 0.0050 | 1.11 | 0.28 |
| 14 | 0.008 | 0.32 | 0.22 | 0.025 | 0.002 | 25.8 | 0.15 | 0.140 | 0.016 | 0.0080 | 0.35 | 0.33 |
| 15 | 0.016 | 0.68 | 0.23 | 0.030 | 0.001 | 24.3 | 0.12 | 0.085 | 0.006 | 0.0045 | 1.25 | 0.36 |
| 16 | 0.009 | 0.55 | 0.33 | 0.025 | 0.001 | 23.5 | 0.13 | 0.075 | 0.004 | 0.0060 | 1.02 | 0.34 |
| 17 | 0.006 | 0.46 | 0.15 | 0.030 | 0.002 | 22.9 | 0.15 | 0.088 | 0.008 | 0.0035 | 1.33 | 0.46 |
| 18 | 0.025 | 0.25 | 0.13 | 0.035 | 0.002 | 21.0 | 0.13 | 0.130 | 0.015 | 0.0025 | 0.80 | 0.20 |
| 19 | 0.008 | 0.36 | 0.25 | 0.025 | 0.001 | 19.0 | 0.15 | 0.050 | 0.008 | 0.0045 | 2.50 | 0.35 |
| 20 | 0.006 | 0.15 | 0.15 | 0.030 | 0.002 | 22.5 | 0.13 | 0.020 | 0.012 | 0.0025 | 0.80 | 0.40 |
| 21 | 0.012 | 0.35 | 0.15 | 0.035 | 0.002 | 21.5 | 0.16 | 0.008 | 0.017 | 0.0025 | 1.06 | 0.25 |
| 22 | 0.008 | 0.35 | 0.22 | 0.025 | 0.002 | 19.2 | 0.16 | 0.008 | 0.009 | 0.0060 | 2.00 | 0.20 |
| A | 0.006 | 0.36 | 0.15 | 0.020 | 0.001 | 21.0 | 0.18 | 0.010 | 0.010 | 0.0050 | 1.49 | 0.37 |
| B | 0.007 | 0.49 | 0.20 | 0.015 | 0.002 | 22.4 | 0.15 | 0.087 | 0.007 | 0.0040 | 1.17 | 0.62 |
| 23 | 0.065 | 0.22 | 0.17 | 0.010 | 0.001 | 16.7 | 0.06 | 0.096 | 0.015 | 0.0035 | 1.01 | 0.09 |
| 24 | 0.004 | 0.33 | 0.22 | 0.025 | 0.002 | 17.8 | 0.23 | 0.072 | 0.004 | 0.0025 | 2.03 | 0.33 |

| Steel No. | Composition (mass %) V | Ti | Cu | Zr | *1 | *2 | *3 | Note |
|---|---|---|---|---|---|---|---|---|
| 1 | 0.14 | 0.01 | — | — | 26.13 | 0.52 | 2.95 | Example |
| 2 | 0.05 | 0.04 | — | — | 26.64 | 0.40 | 0.68 | Example |
| 3 | 0.10 | 0.03 | — | — | 25.12 | 0.59 | 4.08 | Example |
| 4 | 0.17 | 0.03 | — | — | 28.74 | 0.44 | 4.25 | Example |
| 5 | 0.11 | 0.02 | — | — | 28.43 | 0.54 | 1.27 | Example |
| 6 | 0.15 | 0.04 | — | — | 25.46 | 0.65 | 4.35 | Example |
| 7 | 0.03 | 0.04 | — | — | 27.79 | 0.44 | 0.87 | Example |
| 8 | 0.09 | 0.03 | — | — | 27.57 | 0.74 | 4.00 | Example |
| 9 | 0.27 | 0.02 | — | — | 25.43 | 0.60 | 4.03 | Example |
| 10 | 0.08 | 0.01 | — | — | 26.36 | 0.54 | 0.95 | Example |
| 11 | 0.11 | 0.03 | — | — | 26.09 | 0.53 | 1.65 | Example |
| 12 | 0.12 | 0.02 | — | — | 25.69 | 0.48 | 2.09 | Example |
| 13 | 0.05 | 0.04 | — | — | 25.16 | 0.47 | 1.19 | Example |
| 14 | 0.16 | 0.03 | — | — | 26.96 | 0.46 | 4.64 | Example |
| 15 | 0.18 | 0.02 | 0.52 | — | 28.43 | 0.77 | 3.91 | Example |
| 16 | 0.16 | 0.04 | — | 0.22 | 26.87 | 0.63 | 2.71 | Example |
| 17 | 0.01 | 0.02 | 0.62 | 0.31 | 27.29 | 0.55 | 0.11 | Example |
| 18 | 0.03 | 0.02 | — | — | 23.64 | 0.38 | −1.00 | Comparative Example |
| 19 | 0.37 | 0.15 | — | — | 27.25 | 0.41 | 6.67 | Comparative Example |
| 20 | 0.07 | 0.05 | — | — | 25.14 | 0.17 | 1.09 | Comparative Example |
| 21 | 0.01 | 0.08 | — | — | 25.00 | 0.36 | 2.22 | Comparative Example |
| 22 | 0.10 | 0.15 | — | — | 25.80 | 0.36 | 6.25 | Comparative Example |
| A | 0.48 | 0.01 | — | — | 25.92 | 0.37 | 7.93 | Comparative Example |
| B | 0.60 | 0.03 | — | — | 26.26 | 0.58 | 4.72 | Comparative Example |
| 23 | 0.05 | 0.20 | — | — | 20.03 | 0.32 | −0.36 | Technique of Patent Document 1 |
| 24 | 0.02 | 0.66 | 0.44 | — | 24.45 | 0.40 | 0.30 | Technique of Patent Document 2 |

TABLE 2

| Steel No. | Brittle fracture surface ratio (%) at 0° C. in Charpy test | Absorption energy (J/cm$^2$) at 0° C. in Charpy test | Presence/absence of surface defects | Pitting corrosion potential of base material (mV vs SCE) · 3.5% NaCl | Pitting corrosion potential of welds (mV vs SCE) · 3.5% NaCl |
|---|---|---|---|---|---|
| 1 | 0 | 231 | Absent | 522 | 152 |
| 2 | 0 | 245 | Absent | 523 | 149 |
| 3 | 0 | 240 | Absent | 485 | 103 |
| 4 | 5 | 222 | Absent | 560 | 198 |
| 5 | 0 | 224 | Absent | 575 | 159 |
| 6 | 0 | 226 | Absent | 465 | 133 |
| 7 | 0 | 240 | Absent | 564 | 168 |
| 8 | 5 | 218 | Absent | 576 | 175 |

TABLE 2-continued

| | | | | | |
|---|---|---|---|---|---|
| 9 | 0 | 242 | Absent | 485 | 155 |
| 10 | 0 | 238 | Absent | 502 | 145 |
| 11 | 0 | 238 | Absent | 514 | 125 |
| 12 | 0 | 239 | Absent | 435 | 130 |
| 13 | 0 | 246 | Absent | 422 | 105 |
| 14 | 5 | 225 | Absent | 451 | 185 |
| 15 | 5 | 209 | Absent | 569 | 165 |
| 16 | 0 | 237 | Absent | 524 | 150 |
| 17 | 0 | 235 | Absent | 564 | 198 |
| 18 | 0 | 241 | Absent | 515 | −18 |
| 19 | 90 | 27 | Present | 451 | −105 |
| 20 | 0 | 237 | Absent | 423 | −20 |
| 21 | 80 | 38 | Absent | 456 | 106 |
| 22 | 90 | 23 | Present | 402 | −125 |
| A | 0 | 220 | Present | 452 | 14 |
| B | 40 | 95 | Present | 519 | 122 |
| 23 | 70 | 52 | Absent | 253 | −198 |
| 24 | 80 | 43 | Absent | 375 | −154 |

| Steel No. | Pitting corrosion potential of welds (mV vs SCE) · 200 ppmCl⁻ | 0.1% NaCl + 0.1% $CuCl_2$ aqueous solution test | Comprehensive evaluation | Note |
|---|---|---|---|---|
| 1 | 135 | A | ⊙ (A) | Example |
| 2 | 150 | A | ⊙ (A) | Example |
| 3 | 108 | B | ○ (B) | Example |
| 4 | 202 | A | ⊙ (A) | Example |
| 5 | 160 | A | ⊙ (A) | Example |
| 6 | 125 | A | ⊙ (A) | Example |
| 7 | 130 | A | ⊙ (A) | Example |
| 8 | 154 | A | ⊙ (A) | Example |
| 9 | 172 | A | ⊙ (A) | Example |
| 10 | 128 | A | ⊙ (A) | Example |
| 11 | 118 | A | ⊙ (A) | Example |
| 12 | 136 | A | ⊙ (A) | Example |
| 13 | 110 | A | ⊙ (A) | Example |
| 14 | 175 | B | ○ (B) | Example |
| 15 | 150 | A | ⊙ (A) | Example |
| 16 | 145 | A | ⊙ (A) | Example |
| 17 | 179 | A | ⊙ (A) | Example |
| 18 | −56 | C | Δ (C) | Comparative Example |
| 19 | −165 | C | X (D) | Comparative Example |
| 20 | −100 | C | X (D) | Comparative Example |
| 21 | 103 | B | Δ (C) | Comparative Example |
| 22 | −135 | C | X (D) | Comparative Example |
| A | −47 | C | X (D) | Comparative Example |
| B | 135 | B | Δ (C) | Comparative Example |
| 23 | −206 | D | X (D) | Technique of Patent Document 1 |
| 24 | −135 | C | X (D) | Technique of Patent Document 2 |

The invention claimed is:

1. A ferritic stainless steel sheet for a water heater comprising, in terms of mass %, 0.020% or less of C, 0.30 to 0.82% of Si, 1.00% or less of Mn, 0.040% or less of P, 0.010% or less of S, 20.0 to 28.0% of Cr, 0.1 to 0.6% of Ni, 0.03 to 0.15% of Al, 0.020% or less of N, 0.0020 to 0.0150% of O, 0.3 to 1.5% of Mo, 0.25 to 0.60% of Nb, and 0.03% or less of Ti where Ti is present, the remainder being composed of Fe and unavoidable impurities, and the ferritic stainless steel sheet satisfying the following formulae (1) and (2):

$$25 \leqq Cr+3.3Mo \leqq 30 \quad (1)$$

$$0.35 \leqq Si+Al \leqq 0.85 \quad (2)$$

wherein Cr, Mo, Si, and Al represent the contents (mass %) of Cr, Mo, Si, and Al, respectively.

2. The ferritic stainless steel sheet of claim 1, further comprising in terms of mass %, 0.005 to 0.50% of V, more than 22% to 28.0% of Cr, and satisfies the following formula (3):

$$0.1 \leqq 4V/(Nb-8(C+N)) \leqq 5.0 \quad (3)$$

wherein V, Nb, C, N represent the contents (mass %) of V, Nb, C, and N, respectively.

3. The ferritic stainless steel sheet of claim 1 or 2, further comprising in terms of mass %, 0.2 to 1.0% of Cu and/or 0.10 to 0.60% of Zr.

* * * * *